US005475929A

United States Patent [19]

Yancey

[11] Patent Number: 5,475,929

[45] Date of Patent: Dec. 19, 1995

[54] DEVICE AND METHOD FOR ESTIMATING PERCENTAGE OF CALORIES FROM FAT

[76] Inventor: Ira T. Yancey, 332 12th St. E., Bradenton, Fla. 34208

[21] Appl. No.: 339,595

[22] Filed: Nov. 14, 1994

[51] Int. Cl.[6] ..... G06C 3/00

[52] U.S. Cl. ..... 33/15 B; 33/1 B; 33/15 D

[58] Field of Search ..... 33/1 B, 1 AA, 33/15 B, 15 D; 283/115, 65, 117

[56] References Cited

U.S. PATENT DOCUMENTS

| | | | |
|---|---|---|---|
| 2,495,777 | 7/1946 | Schroeder | 33/1 SD |
| 3,514,582 | 5/1970 | Sanderson | 33/1 SB |
| 5,007,174 | 4/1991 | Cook | 33/1 SD |
| 5,178,416 | 1/1993 | Wennik | 283/115 |

*Primary Examiner*—Alvin Wirthlin
*Attorney, Agent, or Firm*—Charles J. Prescott

[57] ABSTRACT

A device and method of estimating a percentage of calories derived from fat contained within each serving of a food product when the amount of fat by weight and total calories per serving of the food is known or may be estimated. The device includes viewable indicia printed on at least one side of a rigid or semi-rigid rectangular sheet. The indicia includes a grid or array of numerals arranged in rows and columns and increasing both horizontally and vertically, each numeral representing a percent of calories derived from fat. The indicia further includes a first increasing numerical scale along an upright margin of the grid, each numeral representing a different amount of fat content by serving weight corresponding to a particular row. A second numerical scale is positioned along a horizontal margin of the grid, each numeral representing a quantitative number of calories corresponding to a particular column. The device also includes a flat, rectangular sleeve slidably engagable along the length of the sheet, the sleeve providing a movable horizontal sight line alignable with any particular row. The sleeve also includes a duplicate or repeat of the second scale positioned along the sight line. When properly positioned in alignment with a particular quantity of fat by serving weight, the sight line is projected along that corresponding row, whereafter the percent of calories from fat may be read immediately adjacent the particular numeral of the duplicate second scale representing total calories in the serving size.

3 Claims, 1 Drawing Sheet

DEVICE AND METHOD FOR ESTIMATING PERCENTAGE OF CALORIES FROM FAT

BACKGROUND OF THE INVENTION

1. Scope of Invention

This invention relates generally to dietary devices, and more particularly to a device and method for estimating the percentage of calories from fat contained within food products.

2. Prior Art

After becoming extremely overweight in previous generations, there has been a growing trend toward reversing that situation. As a result, health food, dietary supplements and weight loss food products, programs, ingredients and dietary aids have been proliferated throughout our society.

To assist consumers in understanding both minimum dietary needs and how packaged food products affect those dietary needs, recent legislation has required that the nutritional content of packaged foods be clearly displayed in simple and concise terms on packaging. Two of the values which provide some level of information to the consumer as to the potential weight gain or loss benefits from consuming that food product are the fat content by weight, e.g. in grams (gms.) and the total number of calories per serving. Although these numbers can be somewhat useful to a knowledgeable consumer, nonetheless separate from other nutritional information, these fat and calorie content values per serving are not sufficient to advise the consumer as to the true weight gain or weight loss nature of that food product.

A normal, healthy body of normal weight consists of approximately twenty percent (20%) fat by weight. With this as a basic understanding, nutritionists and dietitians have come to realize that fat content of food products, rather than total calorie content, is more determinative of whether that food product will result in weight gain, weight loss or neither. Thus, for weight loss purposes, the emphasis has turned from calorie content and calorie counting to a focus upon the amount of fat contained in a food product.

Although guidelines have been set establishing the maximum range of fat by weight recommended for daily consumption, i.e. 30–40 grams, keeping a daily tally of grams of fat consumed is difficult at best based upon the current level of nutritional information on food packaging.

A most useful interpretation for weight loss or gain purposes has come to be known as the percent of calories from fat. This is tied in with the earlier discussion of the normal percentage of body fat, i.e. about twenty to thirty percent. If an individual consumes food which has a percentage of calories from fat of in the range of twenty to thirty percent or less, either weight maintenance or weight loss will occur. On the other hand, if food contained a percentage of calories from fat of in excess: of twenty to thirty percent, weight gain can be expected.

Two factors need to be known to make this determination. The first is the total amount of calories contained in a food serving. The second factor is the total amount of fat by weight (gms.) contained in that food serving. Both of these factors are now required to be on all food packaging. To calculate the percentage of calories from fat in that food serving, the fat content by weight must be converted to calories and then compared to the total number of calories in the serving.

To make this conversion from fat weight (gms.) to fat calories, all that is needed is the number of calories contained in a gram of fat, i.e. approximately nine (9) calories per gram. Armed with this factor then, the formula for determining the percent of calories from fat is as follows:

$$\%\ \text{Calories from fat} = \frac{\text{fat in gms.} \times 9}{\text{total calories}}$$

There appears to be nothing currently available, however, which will aid the consumer in quickly and easily determining whether a particular packaged food product will result in weight gain or loss. That is to say, there is no convenient way to make this calculation of percent of calories from fat based upon the printed nutritional information on the food packaging as one travels through a food market.

The present invention provides such a device which incorporates the above nutritional information into a simple, interactive two component device which provides indicia thereon for determining the percent calories from fat without having to manipulate devices such as a slide rule or a pocket calculator.

BRIEF SUMMARY OF THE INVENTION

This invention is directed to a device and method for estimating a percentage of calories derived from fat contained within each serving of a food product when the amount of fat by weight and total calories per serving of the food is known or may be estimated. The device includes viewable indicia printed on at least one side of a rigid or semi-rigid rectangular sheet. The indicia includes a grid or array of numerals arranged in rows and columns and increasing both horizontally and vertically, each numeral representing a percent of calories derived from fat. The indicia further includes a first increasing numerical scale along an upright margin of the grid, each numeral representing a different amount of fat content by serving weight corresponding to a particular row. A second numerical scale is positioned along a horizontal margin of the grid, each numeral representing a quantitative number of calories corresponding to a particular column. The device also includes a flat, rectangular sleeve slidably engagable along the length of the sheet, the sleeve providing a movable horizontal sight line alignable with any particular row. The sleeve also includes a duplicate or repeat of the second scale positioned along the sight line. When properly positioned in alignment with a particular quantity of fat by serving weight, the sight line is projected along that corresponding row, whereafter the percent of calories from fat may be read immediately adjacent the particular numeral of the duplicate second scale representing total calories in the serving size.

It is therefore an object of this invention to provide a simple device for estimating the percentage of calories from fat contained within food products based upon nutritional information provided on the food product packaging.

It is yet another object of this invention to provide advice for assisting an individual in determining whether packaged food products will result in either weight gain or loss or neither.

It is yet another object of this invention to provide a simple and economical to manufacture device requiring no batteries, mathematical talents or the like in determining the weight gain or loss impact upon the individual as a result of consuming a particular packaged food product.

In accordance with these and other objects which will become apparent hereinafter, the instant invention will now be described with reference to the accompanying drawings.

DETAILED DESCRIPTION OF THE INVENTION

Figure 1:
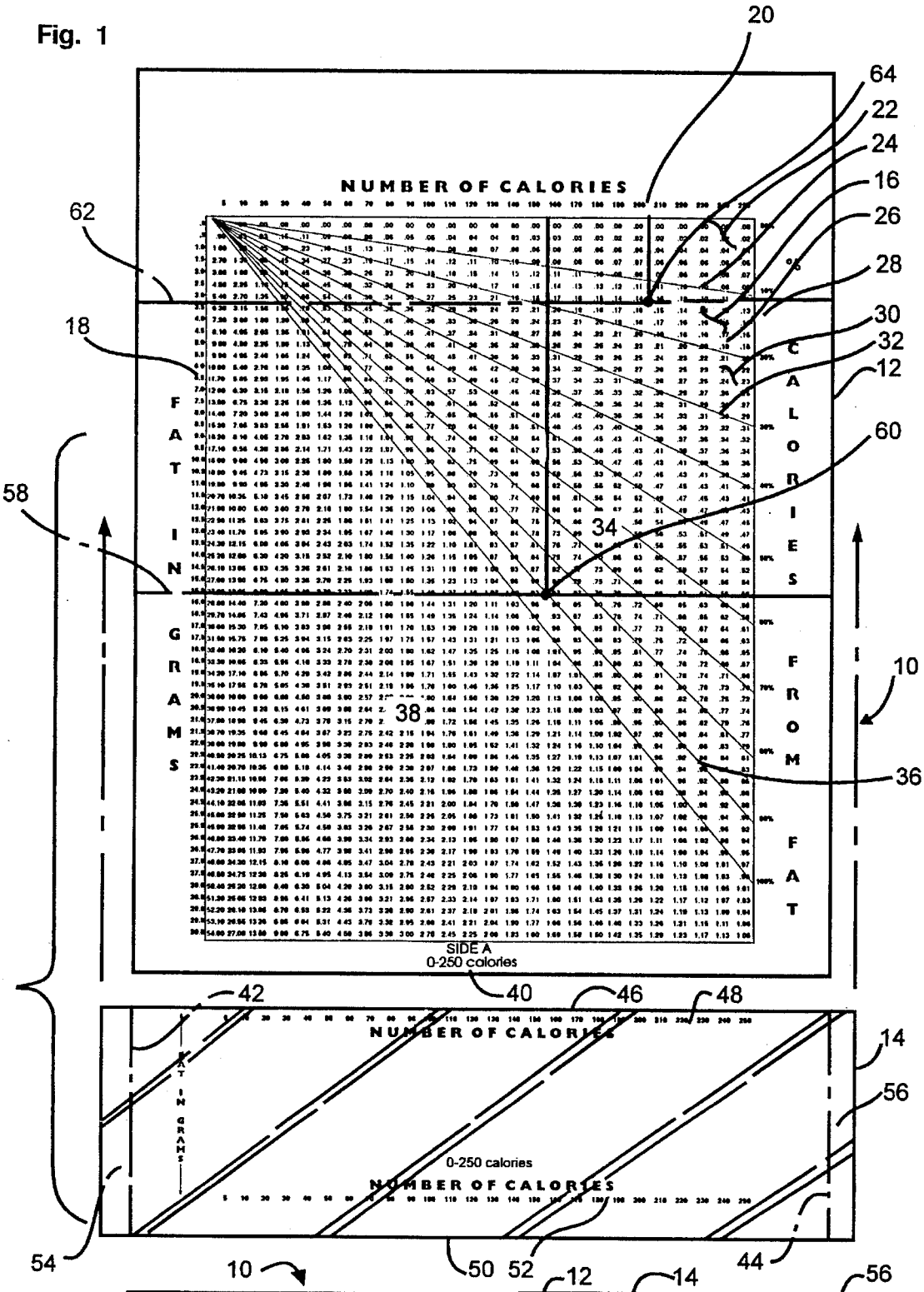
FIG. 1 is a front elevation exploded view of the invention.
Figure 2:
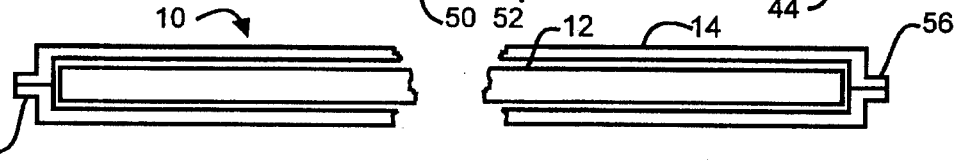
FIG. 2 is a bottom view of FIG. 1.

Referring now to the drawings, the invention is shown generally at numeral 10 and includes a rigid or semi-rigid flat rectangular sheet 12 and a flat, rigid or semi-rigid sleeve 14. Both are generally constructed of a sheet of stiff paper plastic laminated on both sides or, alternately, suitable sized plastic sheet material. Sleeve 14 formed of two mating panels, is open between margins 42 and 44 to slidably receive sheet 12 and heat sealed along 54 and 56.

The rectangular sheet 12 includes indicia printed on at least one and preferably both sides of the sheet 12. The indicia includes a grid 16 of rows and columns of numerals increasing from left to right and from top to bottom, each numeral representing a percentage of calories from fat. A corresponding numeral scale 18 also increasing from top to bottom, includes numerals of fat content in grams. A second numerical scale 20 extending along the upper horizontal margin of the grid 16 includes numerals corresponding to the grid columns of number of calories.

A series of diagonal lines 24, 26, 32 and 36 extend from the zero/zero origin of scales 18 and 20 through preselected percentages of calories from fat numerals within grid 16. Thus, diagonal line 24 depicts the ten percent (10%) calories from fat level, diagonal line 26 depicts the twenty percent (20%) calories from fat level and so forth. Accordingly, region 22 of the grid 16 includes numerals of calories from fat of from zero to ten percent (0–10%), region 30 includes numerals of grid 16 from twenty to thirty percent (20–30%), region 34 representing calories from fat of thirty to one hundred percent (30–100%) and regions 38 with numerals greater than one hundred percent (100%) of calories from fat, i.e. fat saturated foods.

Sleeve 14 is slidably engagable over sheet 12 in the direction of the arrows and preferably transparent in nature, provides a movable horizontal sight line along either margin 46 or 50 which is movably positionable along the length of grid 16 and vertical scale 18.

Two such particular positions of either of these sight lines 46 or 50 are shown by example at sight line positions 58 and 62. These examples are given based upon example nutritional information which would be obtainable on food packaging. Sight line 58 represents a food product having 15.5 grams of fat per serving and a total of 160 calories per serving. These numerals of scales 18 and 20 are projected along the corresponding row and column of grid 16 to intersect at 60 so as to advise the consumer that this particular food product contains ninety percent (90%) of its calories from fat. On that basis, this example food product would clearly result in weight gain.

The second example shown along sight line position 62 is representative of a food product having a total of three (3) grams of fat per serving and a total of 210 calories per serving. Projecting these values from scales 18 and 20 to intersect at 64 shows that this particular example food product contains approximately fifteen percent (15%) of its calories derived from fat. On that basis, although having more calories than that of the first example, this second example food product would result in weight loss by its consumption.

In utilizing the sleeve 14, scale 20 of sheet 12 adjacent grid 16 has been duplicated at 48 and 52 along the sight margins 46 and 50. These "total number of calories" scales 48 and 52 quickly facilitate locating the correct percentage of calories from fat within the grid 16 once the sight margin 46 or 52 has been aligned with the particular amount of fat in grams along scale 18 contained within the food product.

In the preferred embodiment, the front side of sheet 12 displays grid information from zero to two hundred fifty (0–250) calories across each row within grid 16 as indicated at 40 and from zero to thirty (0–30) grams of fat along the vertical scale 18. On the reverse side of sheet 12 (not shown) this grid continues and depicts numerical indicia corresponding to a total number of calorie scale from two hundred fifty to five hundred (250–500) along each row and grams of fat from zero to thirty (0–30) along each column, thus representing a mere extension of the front face of the indicia.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A device for estimating a percentage of calories from fats contained within food products based upon nutritional information describing the food products comprising:

a flat rectangular sheet including indicia printed on one side thereof, said indicia including a grid of numerals, each numeral of said grid representing a percent of calories derived from fat;

said indicia including a first increasing numerical scale along one upright edge of said grid, each numeral of said first numerical scale representing a different amount of fat content by weight corresponding to a particular row of numerals of said grid;

said indicia including a second increasing numerical scale along a horizontal edge of said grid, each numeral of said second numerical scale representing a quantitative number of calories corresponding to a particular column of numerals of said grid;

a flat rectangular sleeve which is slidably engagable over and along a length of said sheet, said sleeve providing a movable horizontal sight line positionable in alignment with a particular said row of numerals;

said sleeve including a duplicate of said second numerical scale viewably disposed along said sight line and in vertical alignment with said second numerical scale;

each numeral of said duplicate, together with said sight line, providing a means for identifying a particular numeral within a specific column and row of said grid, thereby indicating the percentage of calories from fat for a particular fat content by weight and a particular number of calories.

2. A device as set forth in claim 1, further comprising:

diagonal lines of said indicia each extending through said grid and passing through numerals of said grid at a preselected constant level of percent of calories derived from fat.

3. A method of determining a percent of calories derived from fat of food products based upon known values of fat content by weight and total calories contained in each food product comprising:

A. providing viewable indicia applied onto a rectangular flat sheet, said indicia including:

a grid of numerals, each numeral of said grid representing a percent of calories derived from fat;

a first increasing numerical scale along one upright edge of said grid, each numeral of said first numerical scale representing a different amount of fat content by weight corresponding to a particular row of numerals of said grid; and a second increasing numerical scale along a horizontal edge of said grid, each numeral of said second numerical scale representing a quantitative number of calories corresponding to a particular column of numerals of said grid;

B. providing a horizontal sight line of a flat rectangular sleeve which is slidably engagable over and along a length of said sheet, said sleeve including a duplicate of said second numerical scale viewably disposed along said sight line;

C. positioning said sight line vertically on said sheet in alignment with a particular said row of numerals corresponding with one said numeral of said first numerical scale representing a particular fat content by weight of a serving of a food product;

D. locating a particular said numeral of said second numerical scale representing the total calories in the serving;

E. reading a particular numeral of said grid representing a percent of calories from fat viewably positioned immediately adjacent said particular numeral of said duplicate of said second numerical scale.

* * * * *